US006076589A

United States Patent [19]

Hörmann

[11] Patent Number: 6,076,589

[45] Date of Patent: Jun. 20, 2000

[54] ARTICULATED OVERHEAD GATE FOR PARTICULARLY SMALL DROP HEIGHTS

[75] Inventor: Thomas J. Hörmann, St. Wendel, Germany

[73] Assignee: Hörman KG Brockhagen, Steinhagen, Germany

[21] Appl. No.: 09/142,803

[22] PCT Filed: Jan. 9, 1998

[86] PCT No.: PCT/DE98/00059

§ 371 Date: Sep. 28, 1998

§ 102(e) Date: Sep. 28, 1998

[87] PCT Pub. No.: WO98/30776

PCT Pub. Date: Jul. 16, 1998

[30] Foreign Application Priority Data

Jan. 10, 1997 [DE] Germany ..... 197 00 630
Jul. 24, 1997 [DE] Germany ..... 197 31 932

[51] Int. Cl.[7] ..... E05D 15/06

[52] U.S. Cl. ..... 160/201; 160/209; 49/201; 292/77; 292/DIG. 36

[58] Field of Search ..... 160/201, 209; 292/DIG. 36, 77; 16/85, DIG. 10, DIG. 7; 49/197, 201, 213

[56] References Cited

U.S. PATENT DOCUMENTS

| | | | |
|---|---|---|---|
| 1,105,963 | 8/1914 | Clem | 292/77 |
| 1,908,165 | 5/1933 | Moler | 292/DIG. 36 |
| 2,264,642 | 12/1941 | Rowe | 160/209 |
| 2,412,910 | 12/1946 | Rowe | 160/209 |
| 2,426,052 | 8/1947 | Rix | 160/209 |
| 2,703,247 | 3/1955 | Wolf et al. | 292/DIG. 36 |
| 2,846,254 | 8/1958 | Forest | 160/201 |
| 4,095,641 | 6/1978 | Olson | 160/201 |
| 4,878,529 | 11/1989 | Hormann | 160/201 |

FOREIGN PATENT DOCUMENTS 367852 5/1990 European Pat. Off. .

*Primary Examiner*—Blair M. Johnson
*Attorney, Agent, or Firm*—Max Fogiel

[57] ABSTRACT

An articulated overhead gate for gate openings with particularly small drop heights between the upper edge of the gate opening that is to be closed and an adjoining overhead area or similar with a gate leaf consisting of several panels (3, 5) articulated successively in the direction of movement, which are driven by laterally arranged rollers (2) in first lateral roller rails (6), connected in an approximately vertical and thereby curved horizontal direction, excepting the upper panel (5) in closed position, which engages with its rollers (4) which, in this position, are arranged in the upper edge area (30), in second roller rails (7). Said roller rails are parallel to and located above the facing horizontal segments of the first roller rails (6), each segment having an end part (8) facing the gate frame, a first section (10) of which part is lowered only slightly in relation to the horizontal, and a second section (11) correspondingly inclining only slightly over 90° to the horizontal in the direction of the ground. The articulated overhead gate is optionally designed, for manual gate-leaf or motor-driver actuation so that the rollers (4) of the upper panels (5) can be optionally arranged in order to be vertically displaceable in relation to their axes, and so that the transition areas (19) between the first and second sections (10, 11) are each optionally provided with a spring element (12, 15, 15') with a non-rigid deflection surface for the suspension of the roller (4) entering the transition region (19), and for the deflection of the same from one section into the other.

8 Claims, 7 Drawing Sheets

ARTICULATED OVERHEAD GATE FOR PARTICULARLY SMALL DROP HEIGHTS

BACKGROUND OF THE INVENTION

The present invention concerns an articulated overhead door with very little overhead space between the top of the door opening and a ceiling or similar surface. The door comprises several panels linked together one after another in the direction of motion. The panels are guided by rollers at each end traveling in two sets of lateral tracks. The first set of tracks has a more or less vertical section that merges into a curved section and then into a horizontal section. The second set of tracks has a horizontal section and, at the door case, a terminating section. The terminating section has two subsidiary sections. The first subsidiary section slants slightly down from the horizontal. The second subsidiary section is bent down toward the floor just slightly more than 90° to the horizontal. All the panels except the one that is uppermost when the door is closed are guided by rollers that travel in the first set of tracks. The panel that is uppermost when the door is closed is guided by rollers at the upper edge that travel in the second set of tracks. Such doors are preferably balanced by spring assemblies mounted inside the door opening and preferably at the associated ends of the horizontal sections.

The lack of sufficient space above such doors means that the rollers in the uppermost panel must travel such as to ensure that the panel will properly assume its closure position with the rest of the door properly aligned below it. It is accordingly impossible to entirely eliminate a slight slope on the part of the second set of tracks associated with the pair of rollers in the uppermost panel at one side of the door case. Since the doors are intended to be opened and closed manually as well as by a preferably motorized mechanism it must be possible to vary the position of the panel's upper rollers. It must, however, be impossible to raise the door from outside once the rollers associated with the uppermost panel have been moved down in relation to that panel to facilitate manual operation. Yet, when the door is to be opened manually, it must be possible to shift the rollers associated with the uppermost panel into the horizontal sections as smoothly as possible just by raising the door by means of handles attached to it. The motor-powered mechanism generally includes a traction slide that travels straight and is articulated to the uppermost panel. In a position that has been shifted up in relation to the uppermost panel to allow motor-powered operation, it must further be impossible to improperly shift the uppermost panel out of its closure position by forcing the mechanism while an opening motion is being initiated out of the horizontal.

To satisfy the aforesaid requirements, the end of the second set of tracks is specially shaped with respect to the roller positioning surfaces. The horizontal section of the second set of tracks is followed by a subsidiary section that slants slightly down from the horizontal. This is followed in turn by another subsidiary section that is bent down toward the floor just slightly more than 90 ° to the horizontal.

Accordingly designed terminating sections are easy to handle with a motor-powered mechanism. The pair of rollers shifted up will remain in a practical position at the transition between the two sections as long as the door remains closed, and a motion initiated from the horizontal will easily transfer them into the horizontal sections of the second set of tracks. When the door is closed on the other hand, the motorized mechanism will force the rollers associated with the uppermost panel toward the outer corner of track between the subsidiary sections of the terminating section.

A problem will be encountered on the other hand during manual operation when the motion is initiated from the lowermost panel. Since the first section of the second set of tracks is straight, the vertical motion can produce only a weak horizontal force on the rollers associated with the uppermost panel, and a considerable threshold of force will have to be overcome beyond the associated hard impact on these rollers as the door begins to open. As the door begins to close on the other hand, the motion of the uppermost panel's rollers entering the bend between the subsidiary sections will be accelerated before they drop into the vertical second subsidiary section, and the resulting impact will be very noisy.

SUMMARY OF THE INVENTION

The present invention accordingly features a resilient component that engages during manual operation. This component is located at the bend, in the path traveled by the rollers associated with the uppermost panel and has two functions. First, it buffers the rollers at the transition between the first and second subsidiary section of the terminating section of the second set of tracks as the door closes, absorbing the impact against the wall of the terminating section in the vicinity of the door case and decreasing the noise. AS the door opens on the other hand, the resilient component will more gently divert the rollers associated with the uppermost panel, ensuring a transition from the vertical second subsidiary section to the first subsidiary section that bends only slightly down from the horizontal, even given the flexibility of the resilient component, along a curve with a longer radius than that of the bend in the terminating section between the subsidiary sections. The aforesaid threshold of force will accordingly be considerably lowered.

The resilient component in one particular preferred embodiment of the present invention is a leaf spring. It can, however, just as well be a spring positioned between the outer roller-support surface at the end on the one hand and on the other either a strip of material that follows that surface or an accordingly solid piece of a mainly rubber or similar resilient material accommodated in the bend. Since it is needed only when the door is operated manually, and is rather an impediment during motor-powered operation, the resilient component is detachable. When force is applied to move the door, the rollers that are shifted up for that purpose will mainly roll over the surface that is outside in terms of the bend in the terminating section. During manual operation on the other hand, the surface that is inside in terms of the bend will, promoted by the resilient component, accommodate the downward-shifted rollers, increasing the height of the rolling motion.

BRIEF DESCRIPTION OF THE DRAWINGS

Various embodiments of the present invention will now be specified by way of example with reference to the accompanying drawing, wherein.

DESCRIPTION OF THE PREFERRED EMBODIMENTS

Figure 2:
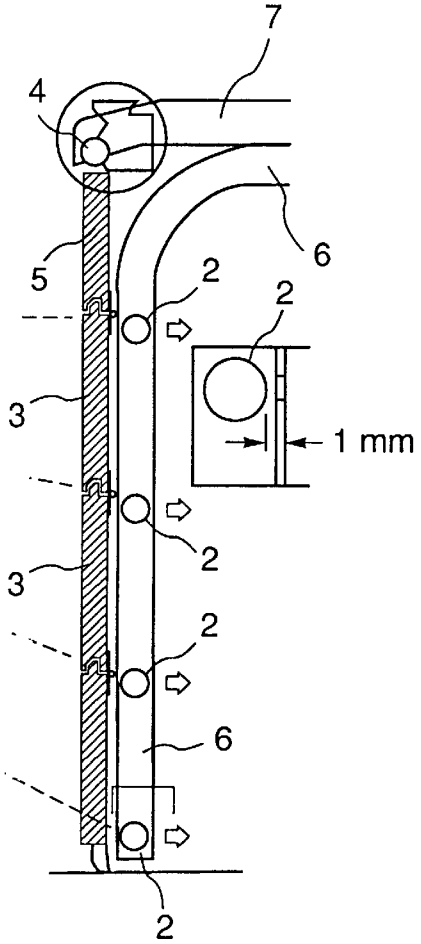
FIG. 2 is a schematic illustration of one corner of the door illustrated in FIG. 1.
Figure 1:
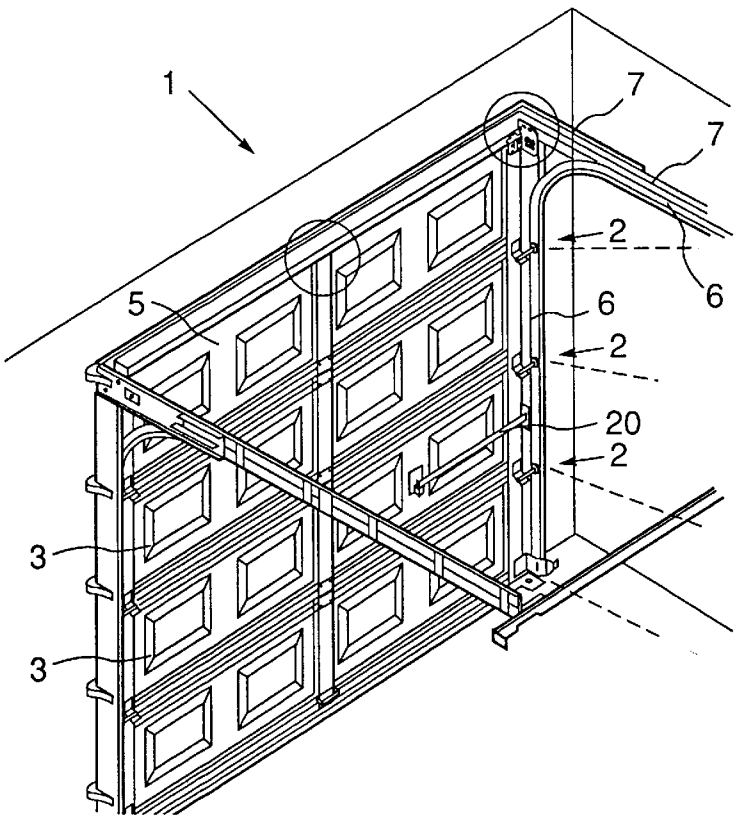
FIG. 1 is a perspective view of one embodiment of an articulated overhead door.
Figure 3:
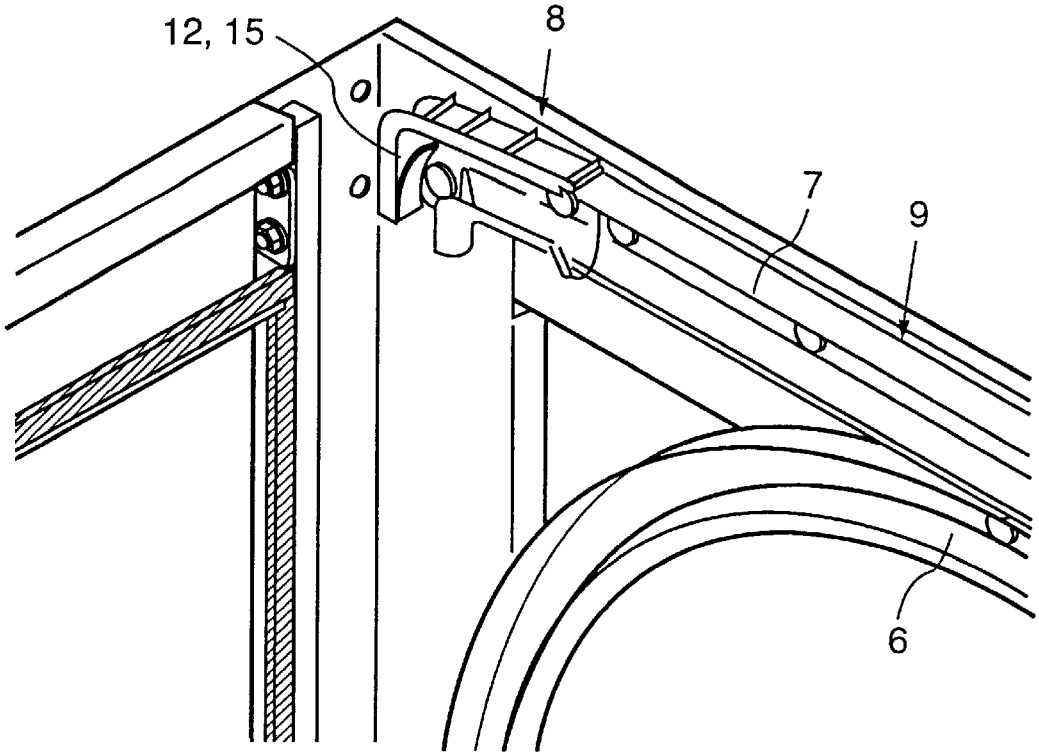
FIG. 3 is a larger-scale perspective view of the area illustrated in FIG. 2.
Figure 4:
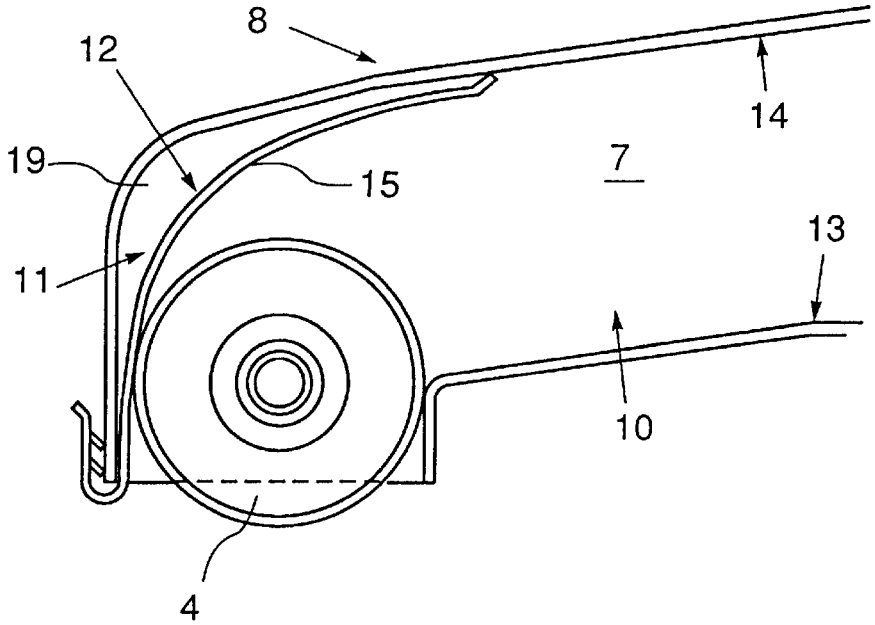
FIG. 4 is an even larger-scale illustration of part of the corner illustrated in FIG. 2 with the door ready to operate manually.

FIG. 1 illustrates a basically conventional articulated overhead door of the genus in accordance with the present invention. The rollers 2 associated with most of the door's panels 3 travel in a set 6 of tracks. The rollers 4 associated with an uppermost panel 5 travel in another set 7 of tracks. The corner indicated by the circle in FIG. 1 is illustrated as viewed from the upper longitudinal strut of the door case is schematically illustrated in FIG. 2, at a larger scale and in perspective in FIG. 3, and at an even larger scale, to illustrate how it functions during manual operation, in FIG. 4. Evident from FIG. 3 in particular is the terminating section 8 of second set 7 of tracks, and specifically in its preferred embodiment as a casting, especially of injection-cast zinc, secured to the end of the horizontal section 9 of second set 7 of tracks facing the door case. FIG. 4 illustrates a surface 13 that supports the rollers in one subsidiary section 10 of the terminating section 8 of second set 7 of tracks and another surface 14 that supports them in another subsidiary section 11 of that terminating section. This particular illustration illustrates the embodiment as it includes a resilient component 12 employed during manual operation along with the rollers 4 associated with uppermost panel 5.

Figure 5:
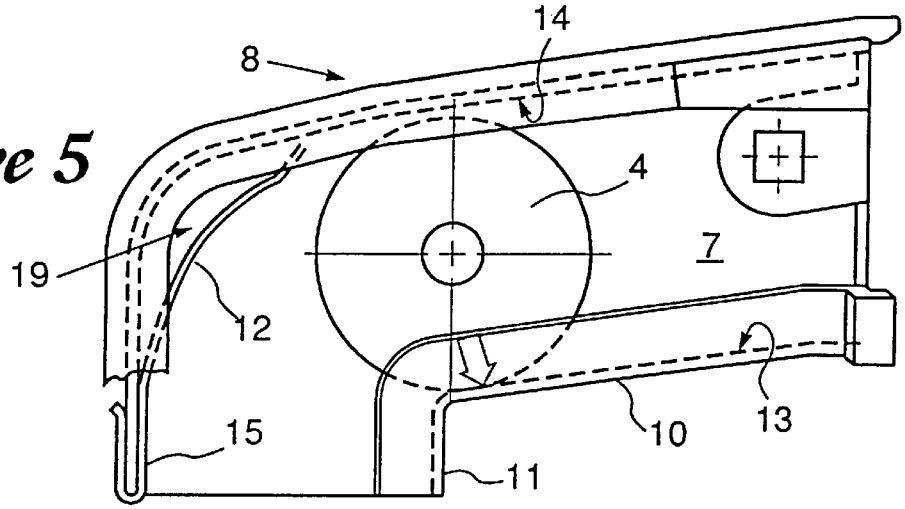
FIGS. 5 through 7 are views similar to that in FIG. 4 and illustrating the door at various stages of closing subject to manual operation.
Figure 6:
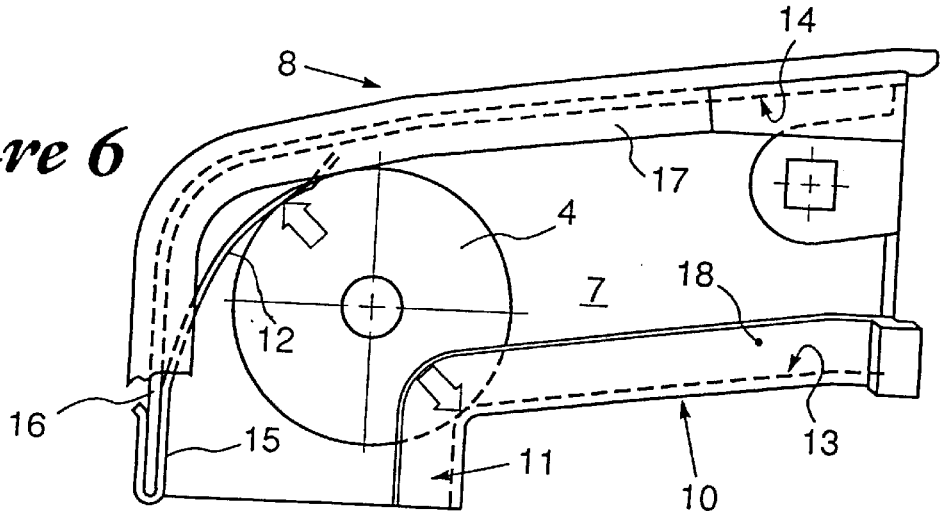
Figure 7:
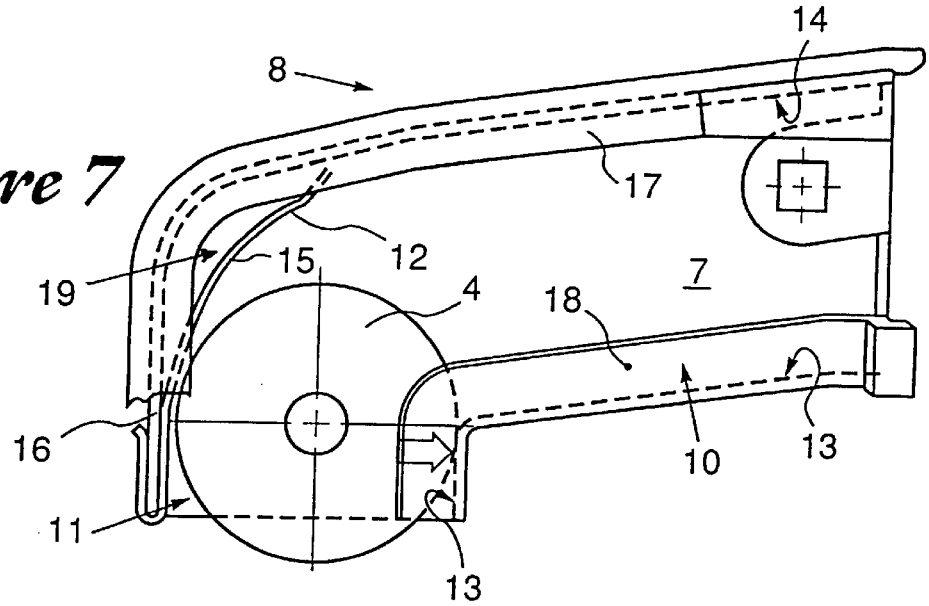

FIGS. 5 through 7 illustrate the terminating section 8 of second set 7 of tracks along with the positions of the rollers 4 associated with uppermost panel 5 while the door is being closed. The broad arrow in FIG. 5 indicates where the rollers rest against the inner roller-support surface 13 of terminating section 8 and those in FIG. 6 also where they rest against a leaf spring 15 clipped over the bottom of a roller-positioning web 16 that constitutes an outer roller-support surface 14 at that point. Terminating section 8 accommodates at least to a considerable extent not only the inner roller-support surface 13 of terminating section 8 but also an outer roller-support surface 14 at the top. Inner roller-support surface 13 has a roller-positioning flange 17, and outer roller-support surface 14 a roller-positioning flange 18. As the aforesaid arrows indicate, uppermost-panel roller 4 engages inner roller-support surface 13 upstream of the bend in terminating section 8 and encounters a resilient component 12 in the form of a leaf spring 15 upon arriving at the transition 19 between subsidiary sections 10. and 11.

Figure 8:
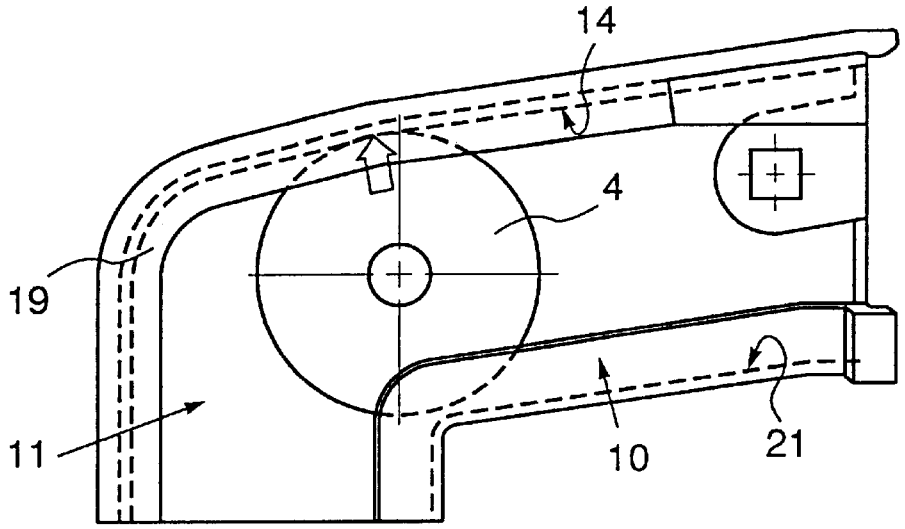
FIGS. 8 and 9 are views similar to those in FIGS. 5 through 7 of the door subject to motor-powered operation.
Figure 9:
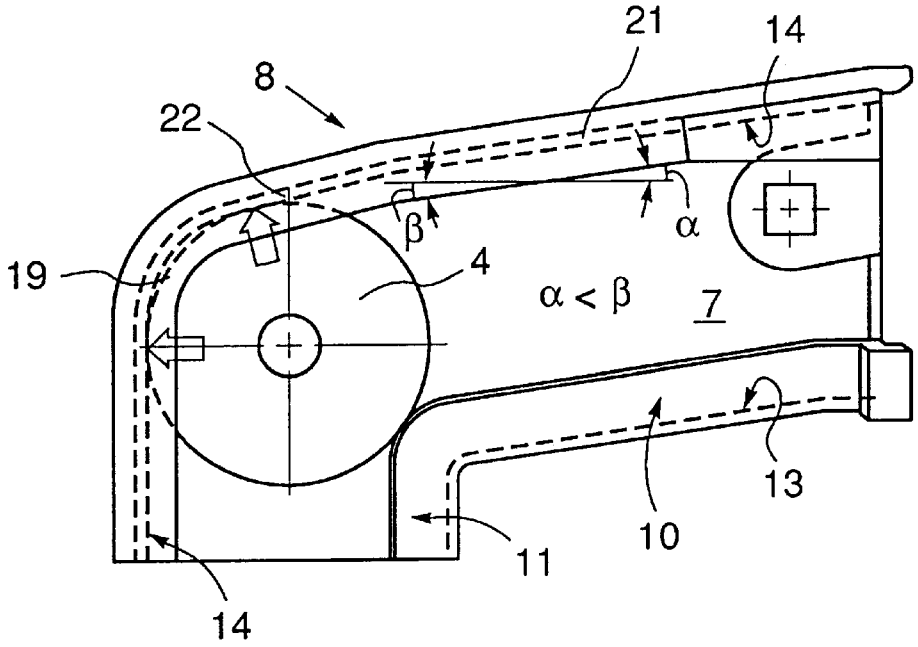

FIGS. 8 and 9 illustrate terminating section 8 while the door is in motor-powered operation, with leaf spring 15 accordingly removed. The thick arrows in these figures indicate that, due to the difference in the introduction of force in this mode of operation, the rollers 4 associated with uppermost panel 5 will also engage the outer roller-support surface 14 downstream of the bend. Whereas, when the door is operated manually as illustrated in FIGS. 5 through 7, the rollers 4 associated with uppermost panel 5 are shifted all the way down into second subsidiary section 11 as the door closes and will accordingly be forced against the inner roller-support surface 13 of terminating section 8 if force is applied to uppermost panel 5 from outside, the upward shift of the rollers characteristic of motor-powered operation will keep them at the transition 19 between subsidiary sections 10 and 11, preventing uppermost panel 5 from yielding to outside force. In manual operation, the door can be bolted closed, and in motor-powered operation it can be locked closed, preferably automatically, by a spring lock 20, which will need to be disengaged before the door can be opened.

Figure 10:
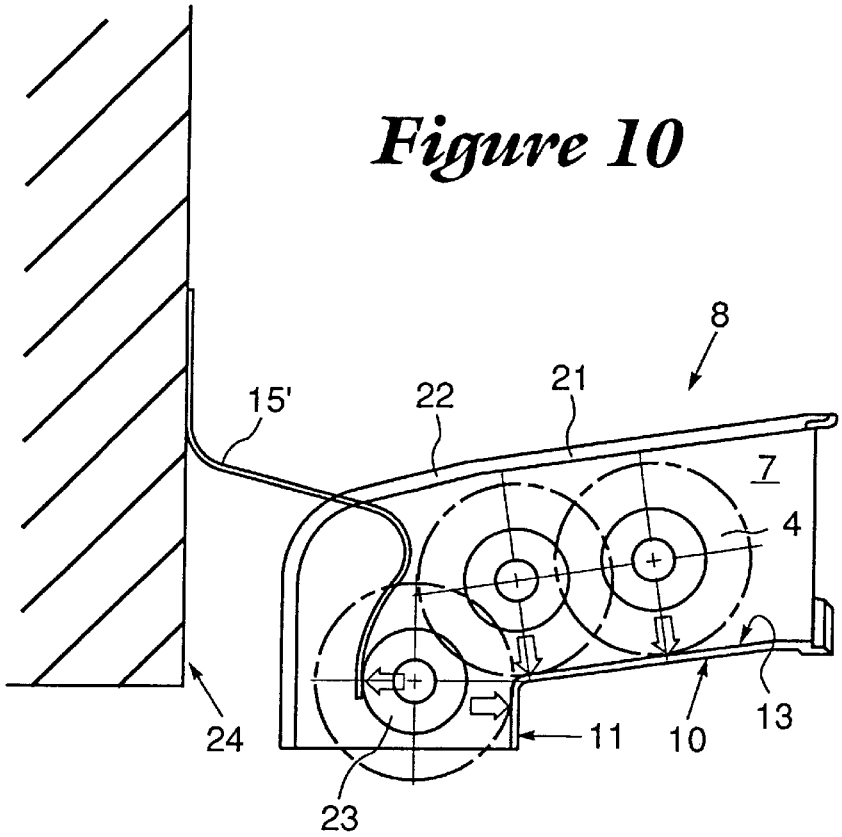
FIG. 10 is a larger-scale schematic view of part of the end of another embodiment of an articulated overhead door.

FIG. 10 illustrates another type of leaf spring 15 that engages either the journal or the shaft of roller 4 or a bushing 23 that accommodates it at the end of second set 7 of tracks. Leaf spring 15 is mounted either on the door case or against the inner surface 24 of the doorway and can be removed or replaced to allow either motor-powered or manual operation.

As will be evident from FIG. 9, the first subsidiary section 10 of the terminating section 8 of second set 7 of tracks slopes slightly down out of the horizontal toward the door case downstream of the horizontal section 9 of set 7 at an acute angle a along a longer length 21 and then along a shorter length 22 at a slightly more obtuse angle B. The more obtuse angle of shorter length 22 facilitates closing the door.

Figure 11:
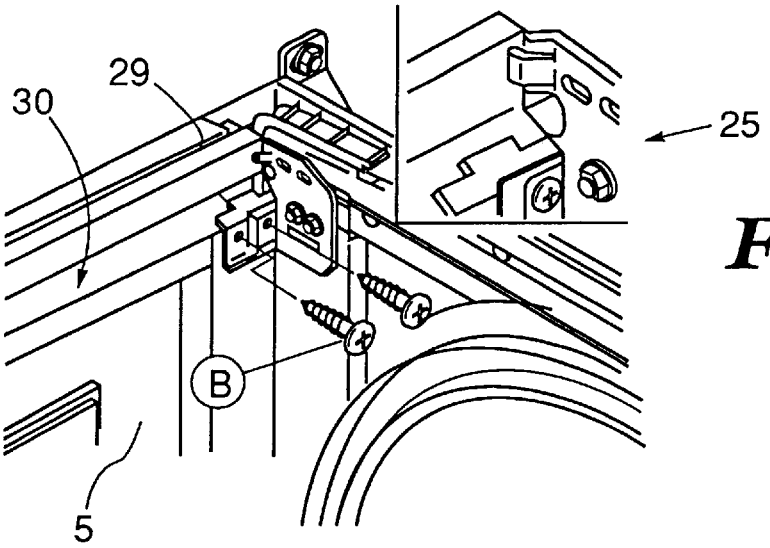
FIG. 11 is a perspective view of one embodiment of a housing for the rollers associated with the uppermost panel of the articulated overhead door illustrated in FIG. 1.
Figure 12:
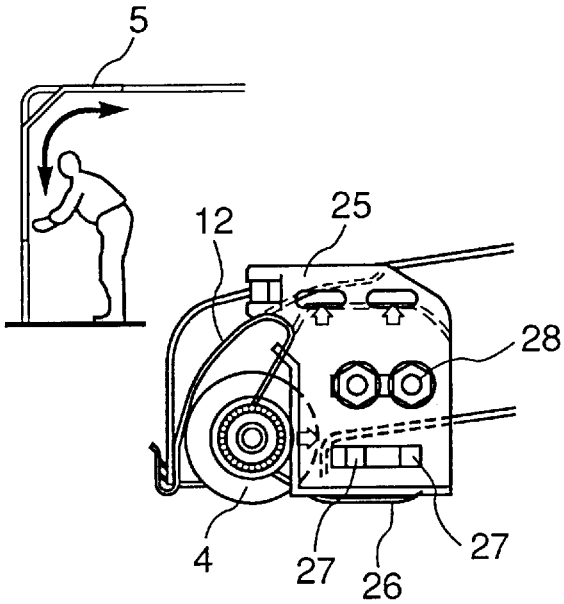
FIG. 12 is a side view of the housing illustrated in FIG. 11 during manual operation.
Figure 13:
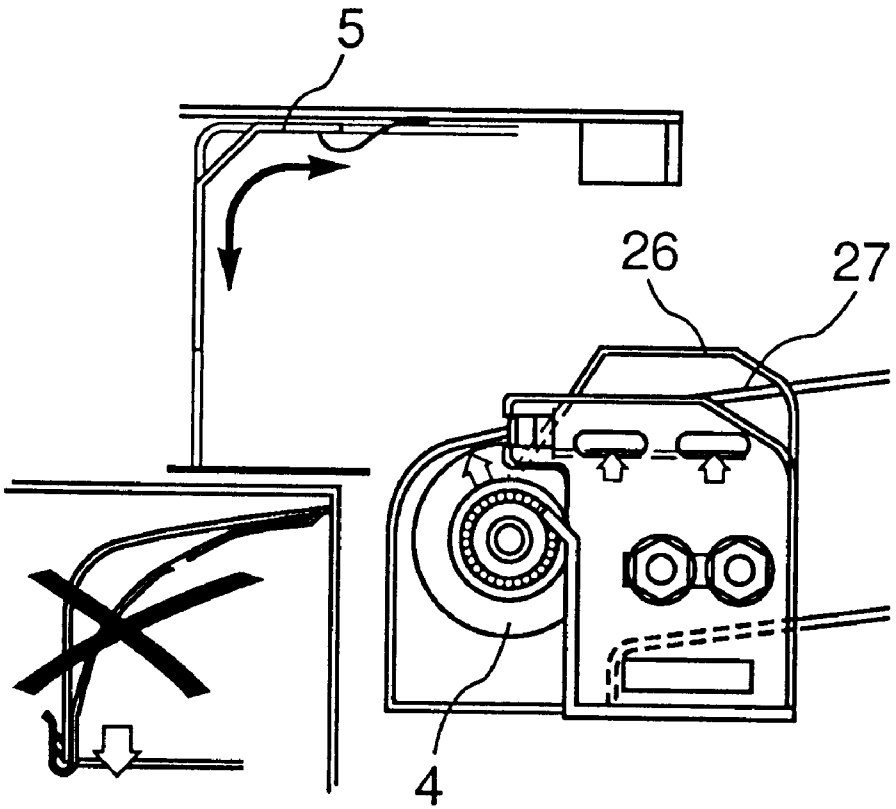
FIG. 13 is a side view of the housing illustrated in FIG. 11 during motor-powered operation.

FIGS. 11 through 13 illustrate one embodiment of a variable housing 25 for accommodating the rollers 4 associated with uppermost panel 5. FIG. 11 is a larger-scale perspective view of the corner indicated by the circle in FIG. 1. FIG. 12 illustrates the rollers shifted down within the housing to allow motor-powered operation in conjunction with resilient component 12, and FIG. 13 illustrates them shifted up and with the resilient component removed to allow motor-powered operation. The position of the rollers can be changed by means of slots 27 in a roller-supporting block 26 that accommodates hexagonal-head screws 28. Slots 27 are positioned to allow such a housing to be mounted on each side of the door. Housing 25 also features a projection 29 that extends toward and rests laterally against the upper edge 30 of uppermost panel 5, re-enforcing the housing's threaded attachment to the inner surface of the uppermost panel, as will also be evident from the detail in FIG. 11.

The spring assemblies that balance the door are mounted not within the area of impact but within the overall assembly, at the end of the horizontal sections of the sets of tracks, especially the second set of tracks, facing into the building. Such a spring assembly can be an assembly of helical tension springs and especially of two such springs with opposing coils, extending along the outside of the tracks. They can also comprise conventional torsion-spring shafts extending into the building from behind the tracks. Such assemblies are attached to the door, to its lowermost panel, that is, in accordance with known principles involving cords that extend around pulleys. Such a torsion-spring shaft will accordingly be provided with cord reels that operate in accordance with known principles, whereby the helical tension springs along the horizontal sections of the second set of tracks in particular are provided at the end facing the door case with a pulley or, to ensure safe operation, with two cords and two idling pulleys.

| List of components |
|---|
| 1. articulated overhead door |
| 2. rollers |
| 3. panels |
| 4. uppermost-panel roller |
| 5. uppermost panel |
| 6. first set of tracks |
| 7. second set of tracks |
| 8. terminating section |
| 9. horizontal section |
| 10. first subsidiary section |
| 11. second subsidiary section |
| 12. resilient component |
| 13. inner roller-support surface |
| 14. outer roller-support surface |
| 15. leaf spring |
| 16. roller-positioning web |
| 17. roller-positioning flange |
| 18. roller-positioning flange |
| 19. transition between subsidiary sections |
| 20. lock |
| 21. longer length of first subsidiary section |
| 22. shorter length of first subsidiary section |
| 23. bushing |
| 24. inner surface of doorway |
| 25. housing |
| 26. roller-supporting block |
| 27. slots |
| 28. hexagonal-head screws |
| 29. projection |
| 30. upper edge of uppermost panel |

What is claimed is:

1. An articulated overhead door comprising: a plurality of movable panels linked together in series for movement in a direction of motion, said panels having panel ends and an uppermost panel; rollers in two sets of tracks at each of said panel ends for guiding said panels in said direction of motion; said two sets of tracks having a first set of tracks with a substantial vertical section merging into a curved section and with said curved section merging into a horizontal section; said two sets of tracks having a second set of tracks with a horizontal section and a terminating section at the door casing; said terminating section comprising a first subsidiary section and a second subsidiary section; said first subsidiary section slanting substantially downward with respect to a horizontal; said second subsidiary section being bent down toward a floor with respect to the horizontal, all panels except said uppermost panel being guided by rollers in said first set of tracks when the door is closed, said uppermost panel being guided at an upper edge by rollers in said second set of tracks when the door is closed; said rollers having axes; shifting means for shifting said rollers guiding said uppermost panel perpendicular to said axes when desired to a transition between said first subsidiary section and said second subsidiary section; said shifting means having a surface applying resilient force to said rollers guiding said uppermost panel as said rollers enter said transition and diverting said rollers from one said subsidiary section to the other said subsidiary section, said rollers guiding said uppermost panel being fixed relative to said uppermost panel during operation; so that said door is operable with substantially little overhead space between a door opening's top surface and ceiling means.

2. A door as defined in claim 1, wherein said first subsidiary section is divided into a first length adjacent the horizontal section of said second set of tracks and into a second length shorter than said first length, said first length and said second length sloping down at angles, said first length sloping down at an angle less than the angle sloped down by said second length.

3. A door as defined in claim 1, wherein said shifting means comprises resilient means in form of a leaf spring with a roller-diverting surface.

4. A door as defined in claim 1, wherein said shifting means is engageable and disengageable from an outer roller-support surface at a bend between each subsidiary section of said second set of tracks, said surface of said shifting means applying said resilient force to the rollers associated with the uppermost panel being a roller-diverting surface.

5. A door as defined in claim 1, wherein said shifting means comprises resilient means attachable to and detachable from said door casing adjacent said second set of tracks and engaging means on a roller at an end of said second set of tracks.

6. A door as defined in claim 1, including a roller-positioning flange extending along said terminating section of said second set of tracks, said shifting means comprises resilient means removably clipped from said roller-positioning flange.

7. A door as defined in claim 1, wherein said rollers associated with said uppermost panel have housings in the form of supports displaceable vertically when the door is closed.

8. A door as defined in claim 7, including a roller-supporting block with fastening means in each of said supports for fastening the support to said uppermost panel, said support having a projection resting against the door and against an upper edge of said uppermost panel for reinforcing said fastening means.

* * * * *